US007648197B1

(12) United States Patent
Delmestri

(10) Patent No.: US 7,648,197 B1
(45) Date of Patent: Jan. 19, 2010

(54) CONVERTIBLE FURNITURE AND METHOD

(76) Inventor: Fabio G. Delmestri, 1416 Wales Dr., High Point, NC (US) 27262

( * ) Notice: Subject to any disclaimer, the term of this patent is extended or adjusted under 35 U.S.C. 154(b) by 440 days.

(21) Appl. No.: 11/188,677

(22) Filed: Jul. 25, 2005

(51) Int. Cl.
*A47C 13/00* (2006.01)

(52) U.S. Cl. ..... 297/63

(58) Field of Classification Search ..... 297/63, 297/65, 66, 353, 452.16
See application file for complete search history.

(56) References Cited

U.S. PATENT DOCUMENTS 821,154 A * 5/1906 Brewer ..... 297/63
1,885,974 A * 11/1932 Winn ..... 5/723
1,968,232 A * 7/1934 Thomas ..... 296/69
2,703,136 A * 3/1955 Masse ..... 297/119
3,469,882 A * 9/1969 Larsen ..... 297/118
3,513,491 A * 5/1970 Gordon ..... 5/420
3,742,526 A * 7/1973 Lillard ..... 5/12.1
3,829,913 A * 8/1974 Bernard ..... 5/46.1
3,902,759 A * 9/1975 Monteforte et al. .... 297/452.16
4,443,901 A * 4/1984 Zimmerman ..... 5/28

FOREIGN PATENT DOCUMENTS

JP 04108409 A * 4/1992

OTHER PUBLICATIONS

Healthcare Design Magazine, May 2005 issue.
One page printout from Brayton International showing a foldable sofa sleeper; undated.

* cited by examiner

*Primary Examiner*—Joseph F Edell

(57) ABSTRACT

Convertible furniture includes a frame having a seat and a back in the sofa mode. A back cushion is positioned normally to a seat cushion and is attached by a flexible tether. The back cushion can be inverted to extend the seat width for use in a bed mode.

7 Claims, 6 Drawing Sheets

CONVERTIBLE FURNITURE AND METHOD

FIELD OF THE INVENTION

The invention herein pertains to furniture and particularly pertains to a sofa which is convertible into a bed by inverting the back cushion.

DESCRIPTION OF THE PRIOR ART AND OBJECTIVES OF THE INVENTION

Over the years many types of sofas and other furniture have been manufactured for dual needs of the user. For example, sofas have been made in the past which include a bed frame concealed beneath the seat cushions. The seat cushions are usually removed and the frame unfolded for use as a bed. Such furniture is generally deemed a "pull-out" and is generally heavy, expensive and often difficult to manipulate by one person. Chairs are also manufactured under various brand names in which a person can sit upright and then, by lever manipulation tilt and extend to furnish horizontal leg support.

Most convertible furniture today is manufactured with complex, mechanical mechanisms to accommodate multiple uses. These mechanisms often become worn, jammed or damaged requiring the owner to repair the mechanism or abandon the convertible features. Such mechanisms have also caused injury to adults, children and pets. In addition, usual convertible furniture is generally heavy due to the weight of the mechanisms, causing the owner difficulty when moving and in rearranging such furniture.

Based on the problems and disadvantages of conventional convertible furniture, the present invention was conceived and one of its objectives is to provide useful, relatively lightweight furniture and a method of use which allows a dual function for the furniture owner.

It is another objective of the present invention to provide furniture which is stylish and aesthetically pleasing in both modes of use.

It is still another objective of the present invention to provide a relatively lightweight sofa and method of use for easily converting into a bed by one person.

It is yet another objective of the present invention to provide a furniture in a sofa mode having a back which includes an invertible cushion for use in the bed mode.

It is a further objective of the present invention to provide furniture having at least one seat cushion which is tethered to a back cushion by a decorative fabric web.

Various other objectives and advantages of the present invention will become apparent to those skilled in the art as a more detailed description is set forth below.

SUMMARY OF THE INVENTION

The aforesaid and other objectives are realized by providing furniture in a sofa mode which includes a frame containing back and seat cushions. The frame includes a pair of arms which are opposingly joined to a back support. The arms and back support may be constructed of wood and are covered with a suitable fabric, polymeric material such as vinyl, leather or the like. One or more seat cushions formed from a conventional polymeric fabric such as polyurethane covered with a fabric are individually attached to similarly constructed back cushions by different fabric tethers. In the sofa mode the back cushions are positioned normal to the seat cushions.

When it is desirable to convert the furniture into the bed mode the method includes the steps of grasping the back cushions and manually raising from their normal position relative to the seat cushions. The back cushions are inverted by rotation and are then positioned against the rear surface of the seat cushions within the sofa frame. The seat cushion top surfaces are then coplanar with the inverted bottom of the back cushions and the flexible tethers are fully exposed and extend therebetween in a taut manner to maintain the back and seat cushions in contiguous relation. A rigid shelf attached to the arms positioned along the lowermost part of the back support allows the inverted cushions to rest thereon at the proper height for a level, top bed surface. The tether is sized and positioned so as to hold the inverted back cushions in a substantially seamless posture contiguous the rear edge of the seat cushions. The available width of the furniture when used in the bed mode is extended by the bottom width of the back cushions to thereby form a suitable bed size.

DETAILED DESCRIPTION OF THE PREFERRED EMBODIMENTS AND OPERATION OF THE INVENTION

Figure 1:
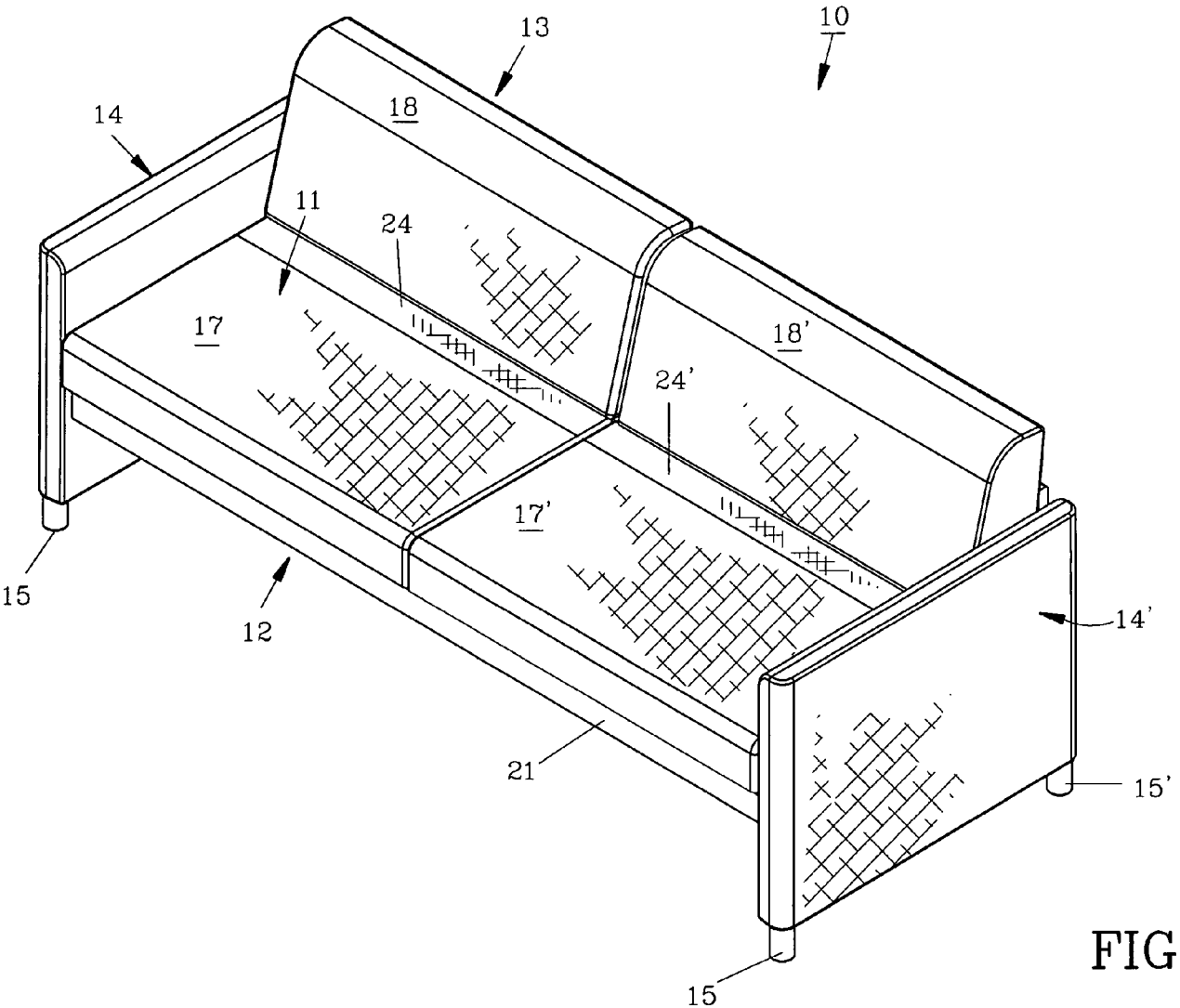
FIG. 1 shows a perspective view of the preferred furniture of the invention in the sofa mode.
Figure 3:
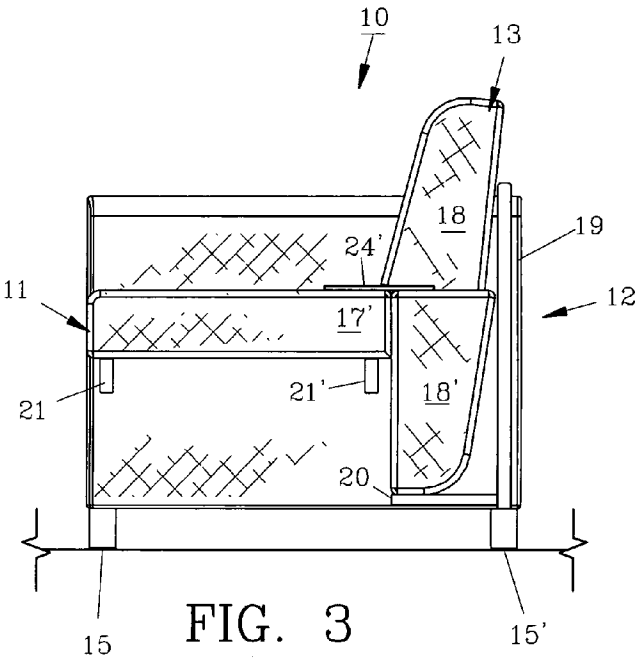
FIG. 3 illustrates the furniture as seen in FIG. 2 but with one rear cushion inverted as when forming the bed mode.
Figure 2:
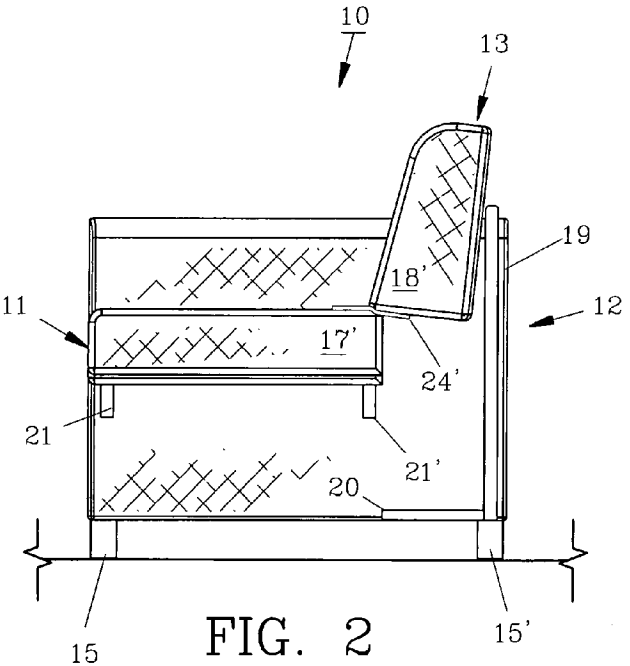
FIG. 2 demonstrates a side view of the furniture as shown in FIG. 1 with the right arm removed.

For a better understanding of the invention and its operation, turning now to the drawings, preferred furniture 10 is shown in FIG. 1 in the sofa mode with seat 11 positioned on frame 12 with back 13 positioned within frame 12 and in contact with seat 11. Frame 12 generally consists of back support 19 having shelf 20 (FIGS. 2 and 3) and arms 14, 14', which are substantially rectangular in shape. Front legs 15 and rear legs 15' are attached to arms 14, 14'. Seat supports 21, 21' are attached to arms 14, 14', as further seen in FIGS. 2 and 3. Furniture 10 includes two (2) fabric covered seat cushions 17, 17' in coplanar relation on frame 12 with back 13 formed by two (2) fabric covered back cushions 18, 18' in normal upright relation thereon as more fully illustrated in FIGS. 2 and 3. Seat cushions 17, 17' are attached respectively to back cushions 18, 18' by preferred fabric tethers 24, 24' as seen in FIGS. 1, 2 and 3. Tethers 24, 24' could also be formed of other flexible material such as vinyl, leather or the like for style and appearance purposes. The tethers prevent the cushions from being lost, stolen or being placed on a floor or other debris loaded or unsanitary site.

In FIGS. 2 and 3, arm 14' has been removed to expose seat 11 and back 13. Also in FIG. 2, frame 12 demonstrates back support 19 having shelf 20 rigidly affixed thereto. Seat supports 21, 21' are seen beneath seat 11 as attached to arm 14. Back cushion 18' is shown in FIG. 3 in an inverted posture with tether 24' exposed. Tether 24' is somewhat exaggerated in thickness for clarity purposes. While preferred furniture 10 as shown in FIG. 1 includes a pair of seat cushions 17, 17', a pair of back cushions 18, 18' and a pair of tethers 24, 24', more or less cushion pairs and tethers could be utilized depending on the exact dimensions and user requirements. Tethers 24, 24' are preferably the same color, fabric and design as the cushions.

Figure 4E:
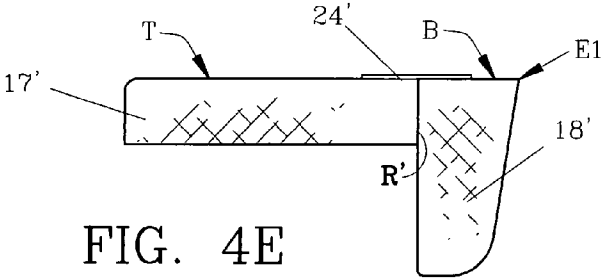
FIGS. 4A-4E feature progressive stages of converting the furniture in schematic form into the bed mode.
Figure 4B:
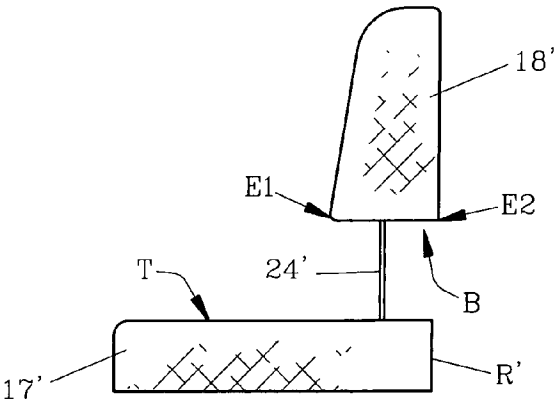
Figure 4D:
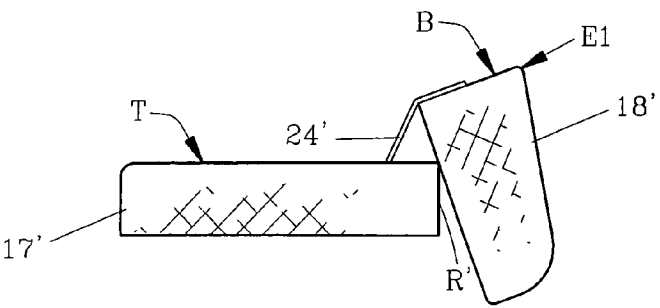
Figure 4A:
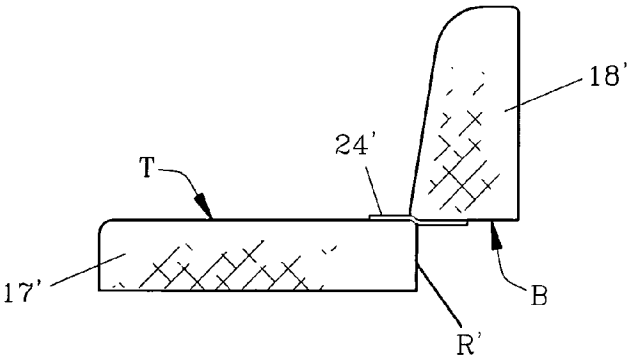
Figure 4C:
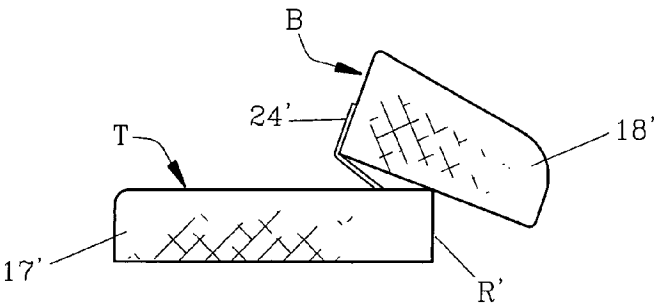

The method of converting furniture 10 is shown schematically in FIGS. 4A-4E. As seen in FIG. 4A, seat cushion 17' having top surface T and rear edge R' has tether 24' affixed thereto. Back cushion 18' includes bottom surface B which is also attached to the opposite end of tether 24' is positioned normal to seat cushion 17' and rests thereon. In FIG. 4B, back cushion 18' has been manually lifted from seat cushion 17' and tether 24' attached respectively to top surface T and bottom surface B fully extends vertically therebetween. Back cushion 18' includes front edge E1 and rear edge E2. In FIG. 4C, back cushion 18' has been rotated clockwise approximately 130° and directed downwardly towards edge R'. In FIG. 4D the clockwise rotation of back cushion 18' is continued as shown with approximately 170° rotation with front edge E1 now facing rearwardly. In FIG. 4E, cushion 18' is fully inverted having been rotated 180° from that shown in FIG. 4A and tether 24' is fully extended and taut with back cushion 18' whereby rear edge E2 is facing forwardly and now resting against rear edge R' of seat cushion 17'. The position of back cushion 18' as depicted in FIG. 4E is stabilized against shelf 20 as seen in FIG. 3. Tether 24' is attached so that its length will maintain back cushion 18' in a taught, normal relation to seat cushion 17', taking into account the cushion thickness and positioning, when positioned in either the sofa or bed mode.

Figure 5:
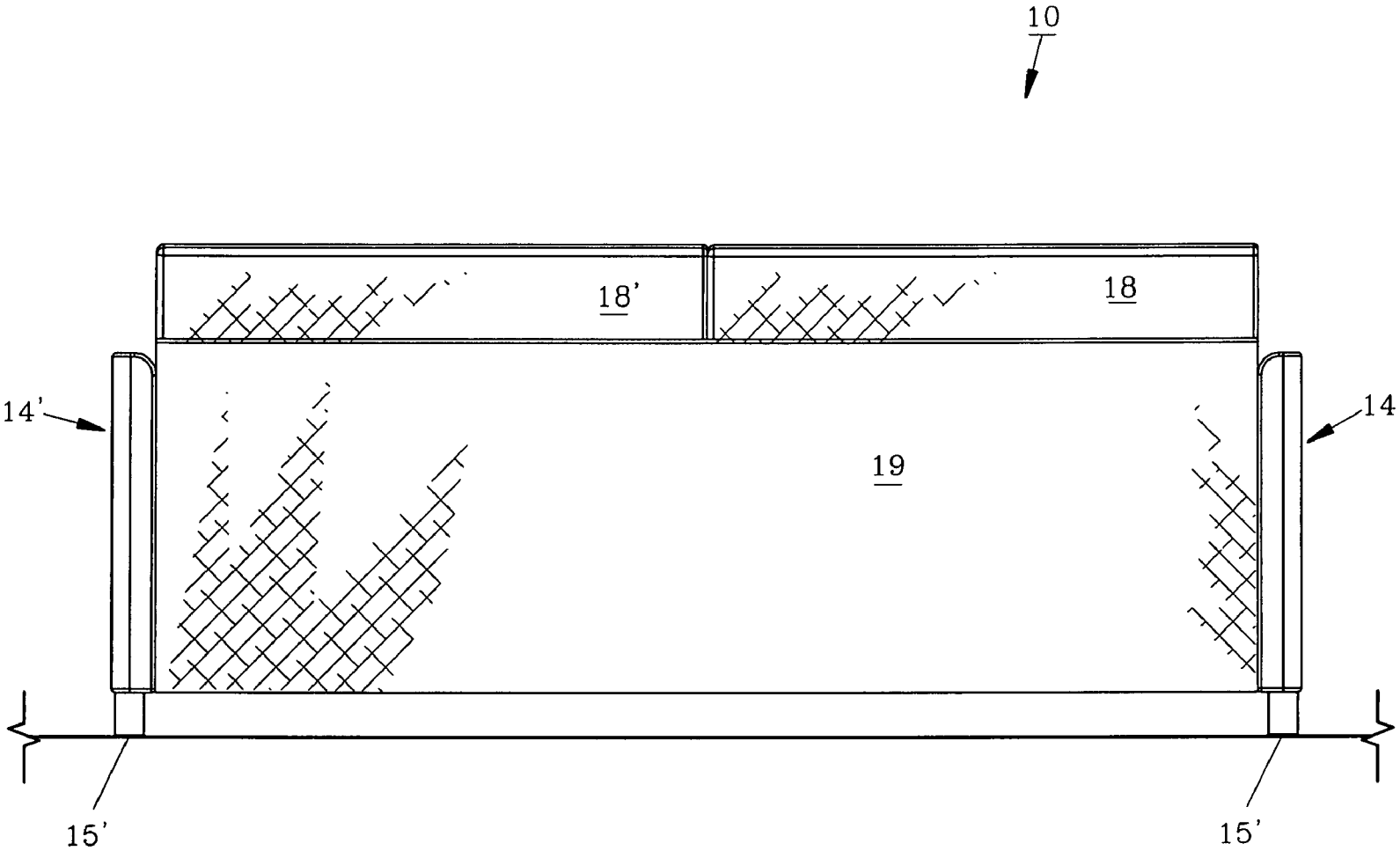
FIG. 5 depicts a rear elevational view of the furniture as seen in FIG. 1.
Figure 6:
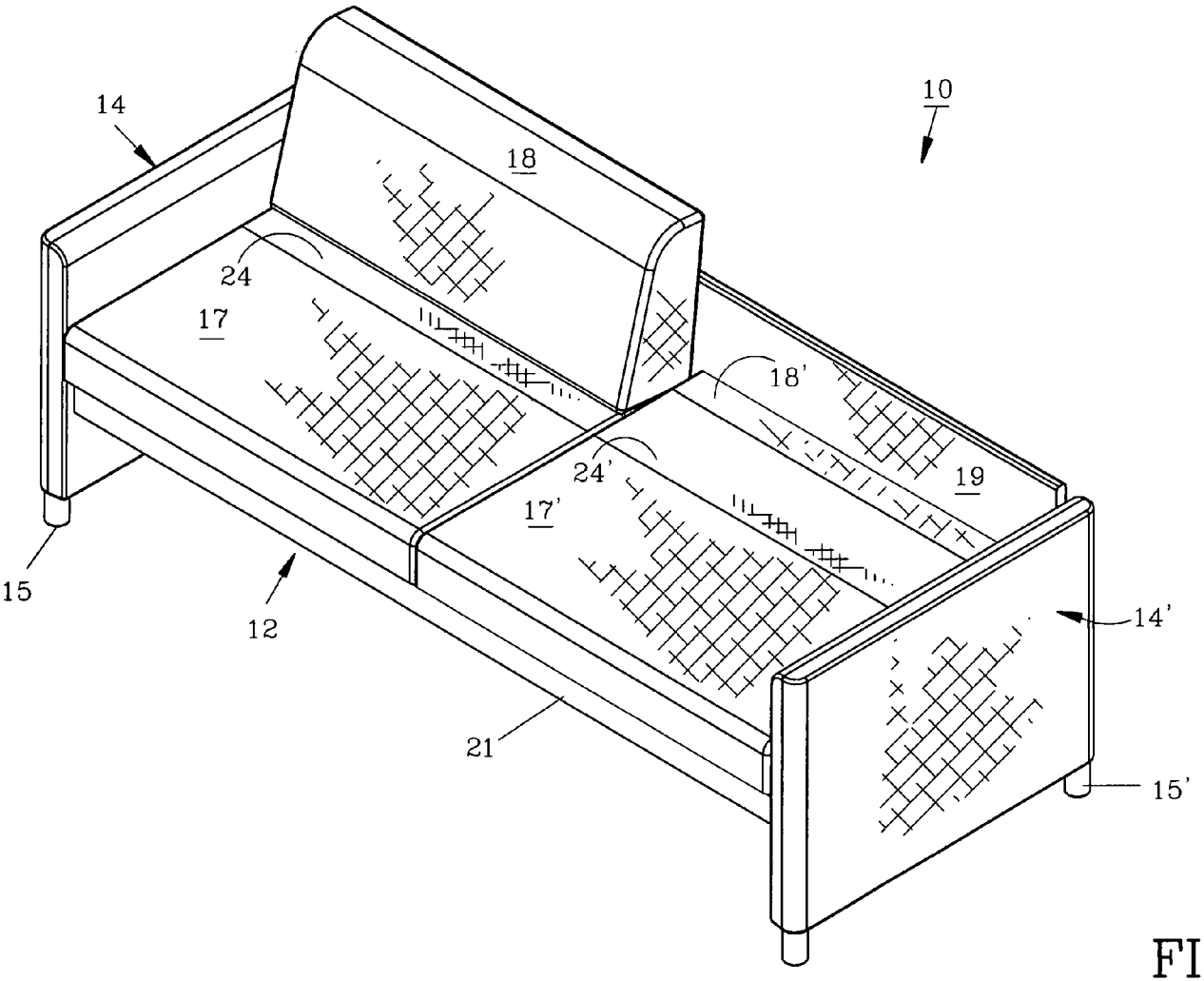
FIG. 6 pictures the furniture of FIG. 1 with one back cushion in an inverted posture.
Figure 7:
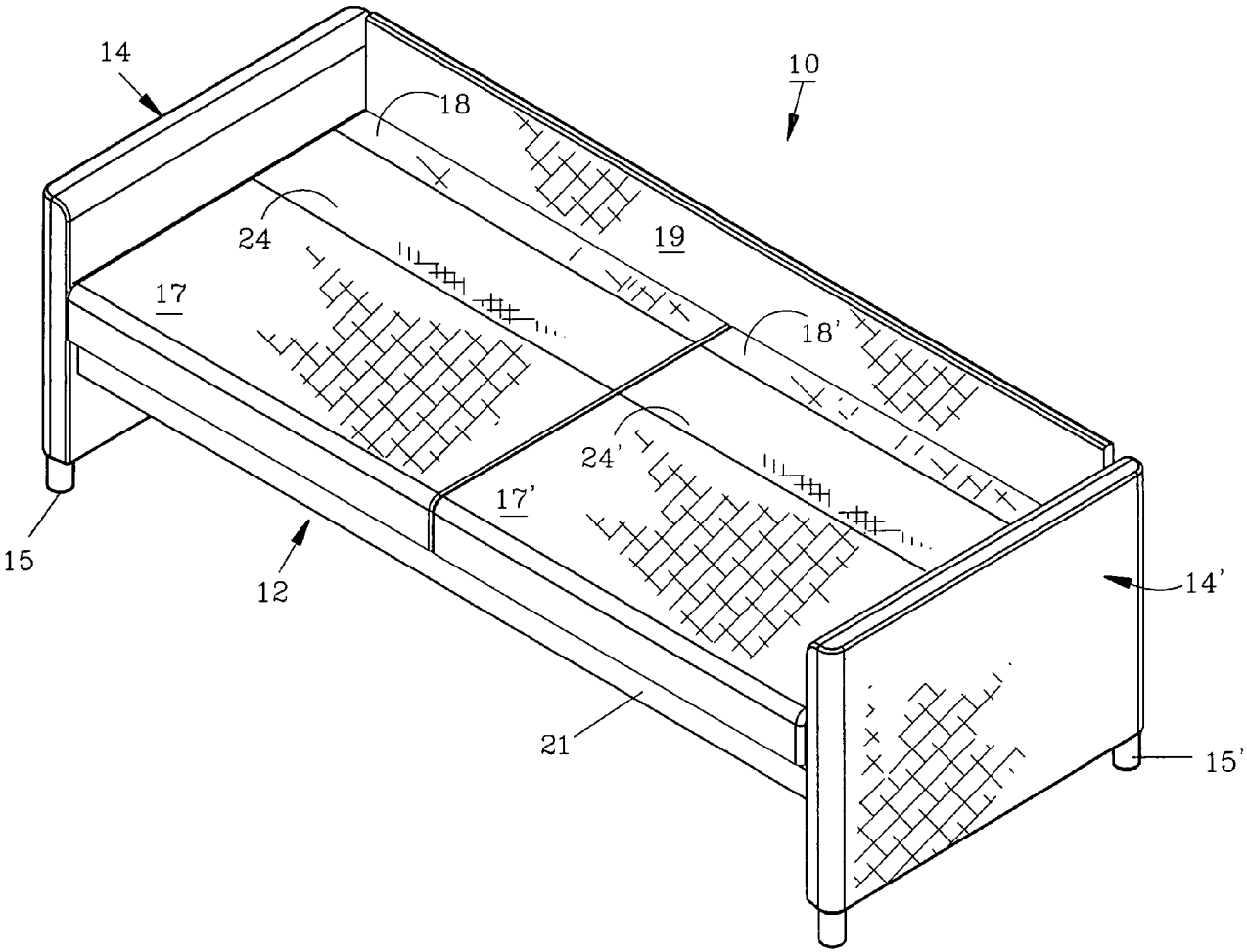
FIG. 7 presents the furniture of FIG. 1 converted into the bed mode.

In a rear view of furniture 10 in FIG. 5, back support 19 extends the full length of furniture 10 where it attaches to arms 14, 14' in forming frame 12. Back support 19 and arms 14, 14' may consist of for example a wooden frame covered by a suitable fabric or other covering. In FIG. 6, furniture 10 is shown with back cushion 18' folded into an inverted posture whereas back cushion 18 is seen in its normal, upright position. In FIG. 7 both back cushions 18, 18' have been inverted for use in the bed mode. Afterwards, furniture 10 can be converted back to the sofa mode by reversing the steps as explained above.

The illustrations and examples provided herein are for explanatory purposes and are not intended to limit the scope of the appended claims.

I claim:

1. A sofa convertible from a sofa mode to a bed mode comprising in the sofa mode: a seat, said seat defining a top surface and a rear edge, a back, said back defining a top surface, a bottom surface, a front edge and a rear edge, said back proximate said seat, a back support, said back support comprising a stationary shelf, said shelf positioned directly below said back, a tether, said tether joined at one end to said seat top surface and joined at the other end to said back bottom surface inwardly from the edges of said back bottom surface and said seat top surface, a pair of arms, said pair of arms affixed to said back support and positioned in opposing relation with said seat and back therebetween, said tether extending a sufficient length to allow said back to rest in a normal position on said seat in the sofa mode and to be inverted whereby said rear edge of said back contacts said rear edge of said seat and is tightly held in a level posture along the rear edge of said seat while said top surface of said back extends below said seat and is stabilized against said shelf in the bed mode.

2. The sofa of claim 1 wherein said back support is positioned between said arms exteriorly of said back.

3. The sofa of claim 2 further comprising a seat support, said seat support positioned between said arms proximate said seat.

4. The sofa of claim 1 wherein said back comprises a pair of cushions.

5. A method of converting furniture from a sofa mode to a bed mode comprising the steps of:

a) providing in the sofa mode a seat defining a top surface and appear edge, a back defining a top surface, a bottom surface, a front edge and a rear edge, the back proximate the seat, a back support comprising a stationary shelf positioned directly below the back, a tether joined at one end to the seat top surface and joined at the other end to the back bottom surface inwardly from the edges of the back bottom surface and the seat top surface, a pair of arms affixed to the back support and positioned in opposing relation with the seat and back therebetween, the tether having a sufficient length to allow the back to rest in a normal position on the seat, and to allow the back to be inverted into a level posture with the seat;

b) separating the back from the seat while the back remains tethered thereto; and c) inverting the back and positioning the inverted back along the rear edge of the seat in contiguous relation whereby the back is level with the seat and the top surface of the back extends below the seat and is stabilized against the stationary shelf.

6. The method of claim 5 wherein separating the back from the seat comprises the step of lifting the back horizontally the length of the tether.

7. The method of claim 5 wherein inverting the back comprises the step of inverting the back one hundred eighty degrees and stabilizing the inverted back against the seat with the bottom surface of the back flush with the top surface of the seat and the top surface of the back extending below the bottom surface of the seat and resting against said stationary shelf.

* * * * *